United States Patent [19]

Stavitsky

[11] Patent Number: 4,919,720

[45] Date of Patent: Apr. 24, 1990

[54] ELECTROLESS GOLD PLATING SOLUTIONS

[75] Inventor: Robert Stavitsky, Bronx, N.Y.

[73] Assignee: LeaRonal, Inc., Freeport, N.Y.

[21] Appl. No.: 213,382

[22] Filed: Jun. 30, 1988

[51] Int. Cl.[5] ..... C23C 3/02; C23C 16/00

[52] U.S. Cl. ..... 106/1.26; 106/1.23

[58] Field of Search ..... 106/1.18, 1.23, 1.26; 427/304, 437

[56] References Cited

U.S. PATENT DOCUMENTS

| | | | |
|---|---|---|---|
| 3,700,649 | 10/1972 | Okinaka | 106/1.26 |
| 3,917,885 | 11/1975 | Baker | 427/304 |
| 3,963,500 | 6/1976 | Flowers et al. | 106/1.26 |
| 4,337,091 | 6/1982 | El-Shazly et al. | 106/1.23 |

FOREIGN PATENT DOCUMENTS

| | | |
|---|---|---|
| 3148330 | 6/1983 | Fed. Rep. of Germany . |
| 3707817 | 9/1988 | Fed. Rep. of Germany . |

OTHER PUBLICATIONS

Ali et al., "A Review of Electroless Gold Deposition Processes," Gold Bull., vol. 17, No. 4 (1984), pp. 118–127.

Okinaka, "An Electrochemical Study of Electroless Gold-Deposition Reaction," J. Electrochem. Socl, 161.120, No. 6 (1973), pp. 739–744.

Matsuoka et al., "Heavy Deposition of Electroless Gold," Plating and Surf. Fin., May, 1988, pp. 102–106.

Metal Finishing Guidebook Directory (1984), p. 824, Table VII.

*Primary Examiner*—Theodore Morris

*Attorney, Agent, or Firm*—Pennie & Edmonds

[57] ABSTRACT

Electroless or autocatalytic gold plating solutions having increased stability through the use of a non-aqueous solvent, preferably ethylene glycol, in an amount of between 50 and 100% of the base solution. Also, the excess free cyanide content of this solution can be controlled at optimum levels by periodic additions of a strong inorganic oxidant such as sodium hypochlorite without adversely affecting the other solution components.

30 Claims, 1 Drawing Sheet

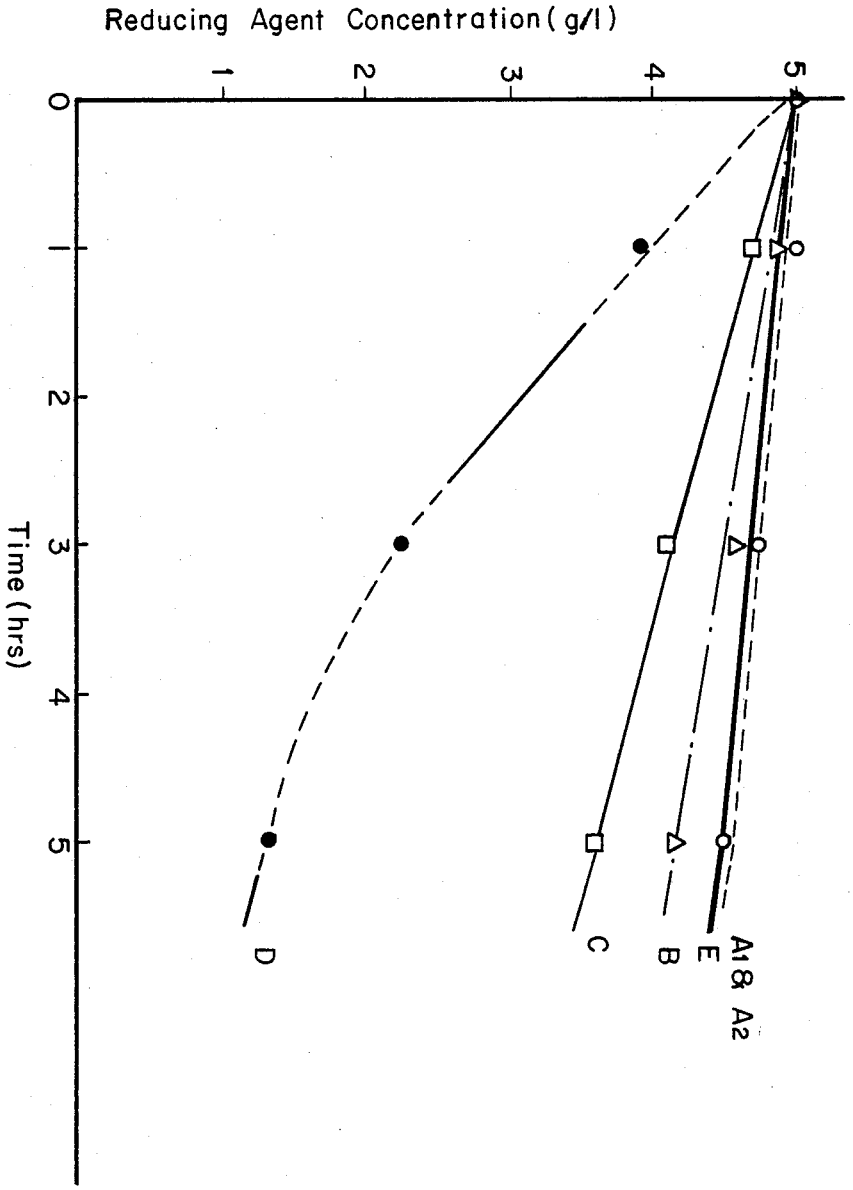
Reducing Agent Concentration (g/l)
5
4
3
2
1
0
1
2
3
4
5
Time (hrs)
A1 & A2
E
B
C
D

ELECTROLESS GOLD PLATING SOLUTIONS

TECHNICAL FIELD

This invention relates to electroless or autocatalytic deposition of gold onto various substrates and, more particularly, to an improved electroless gold plating bath having increased stability.

BACKGROUND OF THE INVENTION

Electroless gold plating methods have been of particular interest to the industry for many years and much has been written about the subject. It is also the subject for a number of patents in the United States as well as in foreign countries. A comprehensive review of the electroless gold deposition process has been published in the "Gold Bulletin" 1984, Volume 17, No. 4, pages 118–127. This paper is a literature study and a technical evaluation of published literature on this subject matter. The paper also contains a great many references including United States and foreign patents relating to electroless gold deposition. The paper points out that the prior art processes are not considered to be suitable for continuous production on a commercial scale, but some of the processes can be utilized in small scale applications with consistent success. Among the problems that limit the commercial success of electroless gold plating are:

1. Control of free cyanide,
2. Methods of replenishing gold,
3. Sensitivity to organic contamination, and
4. Sensitivity to nickel contamination.

The prior art baths that are the most successful contain cyanide complexes of monovalent or trivalent gold, an alkali salt, some free cyanide, and a boron-containing reducing agent. Other additives are also recommended in some prior art baths, such as a buffering compound, a secondary complexing agent, or a chelating agent. It has been noted that one of the most serious contaminants that destabilizes the plating bath is nickel, which exists in the bath as a nickel-cyanide complex. The effect of nickel is to act as a catalyst to cause the spontaneous and rapid deterioration of the boron-containing reducing agent, with reduced plating rates as a result.

Free cyanide is difficult to control in these prior art baths. Cyanide can build up to high concentration levels which over-stabilizes the bath, thereby also reducing the electroplating rate. If gold is continuously replenished in the form of a cyanide complex, then free cyanide can build up rapidly due to the addition of cyanide contained in the gold cyanide complex. Attempts have been made to control this build-up by adding gold in the trivalent state, or in the form of alkali gold hydroxides, or alkali gold aurates, or as gold complexes other than cyanide. Gold added in these forms can control the cyanide build-up by absorbing the excess cyanide in controlled amounts. Although this solution provides one method for controlling free cyanide, other problems are presented, such as cost, availability, and solubility of the non-cyanide gold compound in the plating bath.

SUMMARY OF THE INVENTION

It has now been found that electroless gold plating baths can resist the destabilizing effect of nickel ions when the bath make-up chemicals are dissolved in a non-aqueous medium or a medium which is primarily non-aqueous. This non-aqueous medium is preferably a water-soluble organic liquid, such as ethylene glycol, and the solutions can be between 50% and 100% non-aqueous, with the balance, if any, being water. It has also been found that free cyanide can readily be controlled, even if the bath is continuously replenished with gold cyanide complexes, by adding a hypochlorite compound such as sodium hypochlorite in stoichiometric amounts to the bath to reduce the excess free cyanide content of the bath to acceptable levels. It has been surprisingly found that the sodium hypochlorite reacts preferentially with the excess free cyanide with only minimal attack, if any, on the reducing agent.

Thus, the plating baths of this invention can deposit gold by electroless or auto-catalytic methods with the following characteristics:

1. Plating speeds of about 50 microinches per hour or better
2. Stable solutions which will not spontaneously precipitate gold, even with extended use at high temperatures,
3. Gold replenishments can be made with gold cyanide complexes, without fear of over stabilizing the bath due to excess free cyanide,
4. Stability of the plating bath in the presence of nickel contamination,
5. Stable solutions capable of at least three or more gold turnovers,
6. The ability to plate 100 microinches or more, as required, and
7. Relative simplicity of bath formulation, operation and control.

BRIEF DRAWING DESCRIPTION

The invention is more clearly understood by referring attached drawing FIGURE which illustrates the stability of various electroless gold solutions in the presence of nickel ion contamination.

DETAILED DESCRIPTION OF THE INVENTION

These features of the invention can be realized by using non-aqueous base gold plating solutions. Instead of using aqueous solutions as described in the prior art, a water-soluble organic liquid which is capable of dissolving the chemicals involved in preparation of the solution is used as the basis solution. The preferred organic liquids include organic glycols, particularly ethylene glycol, propylene glycol or the like, with ethylene glycol being most preferred. These solutions can range from completely non-aqueous (i.e., 100% glycol) to at least 50% non-aqueous, with the balance being water.

Gold can be added as the oxide, hydroxide, chloride, iodide, cyanide or organic complex as long as the gold compound is soluble in the solution and capable of forming a complex with cyanide ions. Advantageously, potassium gold cyanide, in either the monovalent or trivalent form, can be used. Other alkali gold cyanides can also be used, such as sodium or ammonium gold cyanide. Monovalent potassium gold cyanide is most preferred since it is less expensive and more readily available. While trivalent potassium gold cyanide can be used, this material contains more cyanide per unit of gold, which would cause the free cyanide to build up more rapidly in the bath. Furthermore, in the presence of the strong reducing conditions in the operating bath, trivalent gold rapidly reduces to monovalent gold. Because of these disadvantages of trivalent gold cyanide, monovalent potassium gold cyanide is normally used. The amount of gold in the solution can vary from 1 to about 10 grams per liter, with 4 to 6 grams per liter being preferred. If the amount of gold falls below 2 grams per liter, the bath should be replenished to avoid obtaining reduced deposition rates.

Some free cyanide should be present in the plating bath so that the gold complex will remain stable without precipitating. If the free cyanide content of the bath falls below about 1 gram per liter, the operating solution can become destabilized and gold can spontaneously precipitate out of solution. Thus, the control of free cyanide has a strong effect on bath stability and the gold plating rate. If the free cyanide is allowed to increase too high, i.e., to above about 15 g/l, the bath will become over-stabilized and the plating rate will fall to a commercially unacceptable value.

According to this invention, free cyanide can readily be reduced in the plating bath by the additions of stoichiometric amounts of a strong inorganic oxidant such as sodium hypochlorite which destroys the excess cyanide and reduce its concentration to acceptable levels. Sodium hypochlorite is generally added when the bath is at room temperature and preferentially reacts with free cyanide with only a minimal effect, if any, on the reducing agent which is present. This result is totally unexpected since it is generally known that, in aqueous systems, such strong oxidants react with boron containing reducing agents. The solution will tend to build up in sodium chloride due to the additions of sodium hypochlorite, however, this build-up has not been found to adversely affect the operation of the bath.

The reducing agents which may be employed in the present electrolytes include any of the boron containing compounds, such as the borohydrides or amine boranes, which are soluble and stable in the glycol base electrolyte. Those most useful in these baths are the alkali metal borohydrides or alkyl amino boranes. Sodium borohydride and dimethyl amino borane are most useful, with dimethyl amino borane being preferred. The concentration of reducing agent can vary from about 1 gram per liter to 10 grams per liter, with 3 to 5 grams per liter preferred. If less than about 2 grams per liter are used, the plating rate may be too low to be commercially acceptable. Above about 5 grams per liter, the effect on plating rate is minimal, but the use of increased concentrations is not necessary and thus, uneconomical.

Various stabilizing agents can be used to improve the performance of the bath. Alkali hydroxides are added to the solution to keep the pH high and to improve deposition rates. Potassium hydroxide is a preferred stabilizing agent in a concentration which can vary from 25 to 75 grams per liter, with 35 to 45 grams per liter preferred. Generally, the bath should have an alkaline pH ranging from about 9–14, and preferably from 11–14.

Buffering salts and complexing or chelating agents can also be added to the bath to further control pH or to enhance plating rate. Such buffering salts can include phosphates, citrates, tartrates, borates, or other known buffering agents that are soluble in the plating bath. Generally, these compounds are added in the form of their alkali salts, such as sodium or potassium salts. Complexing or chelating agents include amino carboxylates such as ethylene diamine tetra acetic acid sodium salt; the succinates or imides described in U.S. Pat. No. 3,917,885, or similar heterocyclic acids such as barbituric acid, chelidamic acid, and the like.

The solvent medium has a boiling point above that of water and therefore operating temperatures are generally above 100° C., with about 100°–140° C. preferred. These high operating temperatures enhance the plating rate to 50 microinches per hour or above, even in the presence of a relatively high free cyanide content. Lower temperatures, such as 85°–95° C. can also be used, but the plating rate may be somewhat reduced.

The organic solvent has a remarkable affect on the ability of the plating bath to remain stable, even in the presence of nickel ions. It has been pointed out by previous investigators that nickel ions are extremely detrimental to the stability of gold plating baths as shown graphically in FIG. 1. A bath containing 40 g/l potassium hydroxide, 10 g/l of potassium cyanide, and 5 g/l dimethyl amino borane was prepared. Reducer concentration versus time for four different solutions were tested. Solution A1 utilized water as the basis solution, while A2 utilized ethylene glycol as the basis solution. These solutions were utilized as controls, were operated for 5 hours at a temperature of 185°–190° F. Solution B utilized a mixture of 75% ethylene glycol, water; Solution C utilized 50% ethylene glycol, 50% water; Solution D utilized 100% water; and Solution E utilized 100% ethylene glycol. Each of Solutions B, C, D, and E included 100 ppm nickel. After 5 of operation, results were as follows:

| Run | Reducer degradation g/l/hr |
|---|---|
| $A_1$ | 0.1 |
| $A_2$ | 0.1 |
| B | 0.17 |
| C | 0.27 |
| D | 0.7 |
| E | 0.12 |

The aqueous plating bath that does not contain nickel is fairly stable, as shown by a minimal drop in reducing agent concentration. When the aqueous solution contains 100 ppm of ionic nickel (Solution D), the bath becomes destabilized and the reducing agent spontaneously drops from 5 grams per liter to 1.3 grams per liter after 5 hours of operation. The nonaqueous solutions are shown to resist the presence of 100 ppm nickel ions, with 100% non-aqueous being the best, 75% (Solution B) next, and 50% non-aqueous (Solution C) not as good as Solution B, but-still considerably better than Solution D.

To summarize the above, the optimum solution composition and operating parameters are as follows:

| | |
|---|---|
| Gold metal (monovalent or trivalent as a complex cyanide) | 3–5 grams/liter |
| Reducing agent (as sodium borohydride or dimethyl amino borane) | 2–5 grams/liter |
| Free cyanide concentration (preferably potassium cyanide) | 3–10 grams/liter |
| Water-soluble organic liquid (ethylene glycol) water | 50–100% balance |
| Stabilizer concentration (Potassium hydroxide) | 30–50 grams/liter |
| Buffering Salts | 0–15 grams/liter |
| Chelating or Complexing Agents | 0–10 grams/liter |
| Temperature | 100–140° C. |
| Solution or workpiece agitation | moderate (mild air agitation can |

-continued

| |
|---|
| be used. |

The following examples illustrate the novel features of the invention.

EXAMPLE 1

Bath Make-up—1 liter solution containing;
Ethylene Glycol—750 mls.
Potassium Hydroxide—40 grams
Potassium Cyanide—2.5 grams
Dimethyl Amino Borane—5 grams
Potassium Gold (I) Cyanide—7.4 grams
Deionized Water—250 mls.
Temperature—102° C.
Solution Agitation—moderate In the above solution cleaned and activated brass panels were placed; after one hour the panels were removed. The thickness of gold deposited using X-ray fluorescence techniques was 60–70 microinches. The constituents were adjusted and the panels plated again for four, one-hour intervals replacing and adjusting constituents giving an average deposition rate of 60 microinches per hour.

EXAMPLE 2

Bath Make-up—1 liter solution containing
Ethylene Glycol—500 mls.
Potassium Hydroxide—40 grams
Potassium Cyanide—2.5 grams
Dimethyl Amino Borane—5 grams
Potassium Gold (I) Cyanide—7.4 grams
Deionized Water—500 mls.
Temperature—102° C.
Solution Agitation—moderate The average plating rate, determined the using technique of Example 1, also resulted in a value of 60 microinches per hour.

EXAMPLE 3

1 liter solution containing
Gold (III) Chloride—6 grams
Potassium Hydroxide—50 grams
Potassium Cyanide—10 grams
Ethylene Glycol—750 mls.
Orotic Acid Monohydrate—15 grams
Dimethyl Amino Borane—5 grams
Deionized Water—250 mls.
Temperature—110° C.
Solution Agitation—moderate The average plating rate, again determined using the technique of Example 1, resulted in a value of 100 microinches per hour.

EXAMPLE 4

1 liter solution containing
Potassium Gold (I) Cyanide—7.4 grams
Potassium Hydroxide—50 grams
Potassium Cyanide—2.5 grams
Ethylene Glycol—750 mls.
Dimethyl Amino Borane—5 grams
Orotic Acid Monohydrate—15 grams
Deionized Water—250 mls.
Temperature—110° C.
Solution Agitation—moderate The plating rate was determined to be 100 microinches per hour.

EXAMPLE 5

1 liter solution containing
Potassium Gold (III) Cyanide—7.3 grams
Potassium Cyanide—7.5 grams
Potassium Hydroxide—40 grams
Dimethyl Amino Borane—5 grams
Ethylene Glycol—750 mls.
Nickel Sulfate—0.11 grams
Deionized Water—250 mls.

The plating rate, determined using the technique of Example 1, was found to be 60 microinches per hour. The bath remained stable with the 0.11 grams (20 ppm.) of nickel metal contamination, no spontaneous decomposition of plating bath occurred as mentioned in M. Matsuoka & et al., "Heavy Deposition of Electroless Gold"; Plating and Surface Finishing; May, 1988, for an aqueous bath containing 5.0 ppm. nickel contamination.

EXAMPLE 6

1 liter solution containing
Potassium Gold (III) Cyanide—7.3 grams
Potassium Cyanide—3.5 grams
Potassium Hydroxide—40 grams
Ethylene Glycol—750 mls.
Dimethyl Amino Borane—5.0 grams
Wetting Agent (Triton X-100) 20 ppm
Deionized Water—250 mls.

The plating rate was again determined using the technique of Example 1 and found to be 50 microinches per hour. The addition of the wetting agent improved the deposit thickness variation between the polished side of brass panel and the rough side from a range of 40 to 60 microinches when the wetting agent is not included, to 50 to 55 microinches. The wetting agent, Triton X-100, is a tradename for octylphenoxy polyethoxy ethanol and is available from Rohm & Haas. This example shows that a wetting agent can be added with beneficial results.

EXAMPLE 7

1 liter solution containing
Potassium Gold (I) Cyanide—7.4 grams
Potassium Hydroxide—40 grams
Potassium Cyanide—3.5 grams
Ethylene Glycol—750 mls.
Dimethyl Amino Borane—5 grams
Deionized Water—250 mls.

The above solution was analyzed for Potassium Cyanide and Dimethyl Amino Borane. The Potassium Cyanide was 3.5 grams/liter and the Dimethyl Amino Borane was 4.9 grams/liter. To this 70 mls. of a 5% Sodium Hypochlorite solution was added. After 15 minutes of stirring the bath was resampled and analyzed. The Potassium Cyanide level was now 2.6 grams/liter and the Dimethyl Amino Borane was 4.9 grams/liter. Literature values for cyanide destruction suggest that 3.5 grams of Sodium Hypochlorite are needed to destroy 1.0 grams of Potassium Cyanide at a pH above 11 while the value found here was 3.7 grams of Sodium Hypochlorite per gram of Potassium Cyanide. This demonstrates that the cyanide ion is preferentially destroyed and the reducing agent is substantially unaffected.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. An electroless or autocatalytic gold plating solution comprising:

a source of cyanide ions;

a soluble gold compound capable of forming a gold cyanide complex in the solution;

a reducing agent; and a solvent for the preceding components comprising between at least 50 to 100% by weight of a water soluble organic glycol which enables the solution to remain stable in the presence of nickel ions, with the balance, if any, being water.

2. The solution of claim 1 wherein the solvent comprises between about 50 and 100% of a glycol.

3. The solution of claim 3 wherein the glycol is ethylene glycol.

4. The solution of claim 1 wherein the reducing agent is a solution soluble borohydride or amino borane compound.

5. The solution of claim 1 wherein the cyanide ions are supplied by an alkali metal cyanide salt.

6. The solution of claim 5 wherein the cyanide salt is potassium cyanide.

7. The solution of claim 1 further comprising a stabilizing agent.

8. The solution of claim 7 wherein the stabilizing agent is a hydroxide compound.

9. The solution of claim 1 further comprising at least one of a chelating agent, a buffering agent, or a complexing agent.

10. The solution of claim 9 wherein the chelating agent is an amino carboxylate or salt thereof; the buffering agent is a phosphate, citrate, tartrate, or borate compound; and the complexing agent is an imide or a heterocyclic compound.

11. The solution of claim 1 further comprising a strong oxidant in an amount effective to reduce the free cyanide content of the solution to below 15 g/l.

12. The solution of claim 11 wherein the oxidant is a hypochlorite compound.

13. The solution of claim 1 having a pH ranging from between about 11 and 14 and wherein the solvent has a boiling point above that of water so that the solution can be used at a temperature between about 100° and 140° C.

14. An electroless or autocatalytic gold plating solution comprising:

a source of cyanide ions in a concentration of between about 3 and 10 g/l;

a soluble gold compound capable of forming a gold cyanide complex in the solution in a concentration of between about 3 and 5 g/l;

a reducing agent in a concentration of between about 2 and 5 g/l; and a solvent for the preceding components comprising between at least 50 and 100% by weight of ethylene glycol, with the balance, if any, being water, said solution capable of remaining stable in the presence of nickel ions.

15. The solution of claim 14 further comprising between about 30 to 50 g/l of a stabilizing agent.

16. The solution of claim 15 wherein the reducing agent is a solution soluble borohydride or amino borane compound; the stabilizing agent is a hydroxide compound; the cyanide ions are supplied by an alkali metal cyanide salt; the pH of the solution ranges from about 11 to 14; and the temperature of the solution ranges from about 100° to 140° C.

17. The solution of claim 14 further comprising at least one of a chelating agent, a buffering agent, or a complexing agent.

18. In an electroless or autocatalytic gold plating solution comprising:

a source of cyanide ions;

a soluble gold compound capable of forming a gold cyanide complex in the solution;

a reducing agent; and a solvent for the preceding components comprising a water soluble organic glycol liquid, wherein excess cyanide ions are formed during the deposition of gold from said solution, the improvement which comprises maintaining the cyanide ions at a concentration below about 15 g/l by periodically adding to said solution, a sufficient amount of a strong oxidant as required, which oxidant reacts with said excess cyanide ions without substantially affecting the reducing agent.

19. The solution of claim 18 wherein the solvent comprises ethylene glycol, the oxidant is a hypochlorite compound, and wherein the cyanide concentration is maintained in the range of between about 3 and 10 g/l.

20. The solution of claim 18 having a pH of between about 11 and 14, wherein the solvent has a boiling point above that of water so that the solution can be used at a temperature of between about 100° and 140° C., and further comprising at least one of a stabilizing agent, a chelating agent, a buffering agent or a complexing agent.

21. The solution of claim 18 wherein the solvent comprises between at least 50 to 100% by weight of a water-soluble organic liquid which enables the solution to remain stable in the presence of nickel ions, with the balance, if any, being water.

22. The solution of claim 21 wherein the water-soluble organic liquid comprises ethylene glycol and the reducing agent is a solution soluble borohydride or amino borane compound.

23. The solution of claim 18 wherein the water soluble organic liquid comprises a glycol and further comprising a stabilizing agent.

24. The solution of claim 23 wherein the glycol is ethylene glycol and the stabilizing agent is a hydroxide compound.

25. The solution of claim 20 wherein the solvent comprises ethylene glycol; the stabilizing agent is a hydroxide compound; the chelating agent is an amino carboxylate or salt thereof; the buffering agent is a phosphate, citrate, tartrate or borate compound; and the complexing agent is an imide or a heterocyclic compound.

26. A solution for electroless or autocatalytic deposit of gold upon a substrate consisting essentially of:

a source of cyanide ions;

a soluble gold compound capable of forming a gold cyanide complex in the solution;

a reducing agent for reducing gold ions of the gold cyanide to gold metal upon the substrate; and a solvent for the preceding components comprising at least 50 to 100% by weight of a water soluble organic glycol which enables the solution to remain stable in the presence of nickel ions, with the balance, if any, being water.

27. The solution of claim 26 wherein the solvent is ethylene glycol and the reducing agent is a solution soluble borohydride or amino borane compound.

28. The solution of claim 26 further consisting essentially of an strong oxidant in an amount effective to reduce the free cyanide content of the solution.

29. The solution of claim 28 wherein the oxidant is a hypochlorite compound.

30. The solution of claim 26 further consisting essentially of a stabilizing agent, a chelating agent, a buffering agent or a complexing agent.

* * * * *